US008763178B1

(12) United States Patent
Martin et al.

(10) Patent No.: US 8,763,178 B1
(45) Date of Patent: Jul. 1, 2014

(54) LOW PROFILE PATIENT EXAMINATION TABLE

(75) Inventors: Willis E. Martin, Rocky Mount, NC (US); Rodney Barr, Cary, NC (US)

(73) Assignee: Martin Manufacturing Co., LLC, Rocky Mount, NC (US)

( * ) Notice: Subject to any disclaimer, the term of this patent is extended or adjusted under 35 U.S.C. 154(b) by 621 days.

(21) Appl. No.: 12/858,804

(22) Filed: Aug. 18, 2010

Related U.S. Application Data

(60) Provisional application No. 61/235,104, filed on Aug. 19, 2009.

(51) Int. Cl.
*A47B 7/00* (2006.01)

(52) U.S. Cl.
USPC ..... 5/611; 5/11; 5/118

(58) Field of Classification Search
USPC ..... 5/611, 11, 118
See application file for complete search history.

(56) References Cited

U.S. PATENT DOCUMENTS

| | | | | |
|---|---|---|---|---|
| 5,528,782 | A * | 6/1996 | Pfeuffer et al. | 5/611 |
| 6,421,854 | B1 * | 7/2002 | Heimbrock | 5/610 |
| 6,615,430 | B2 * | 9/2003 | Heimbrock | 5/601 |
| 6,866,288 | B2 * | 3/2005 | Martin | 280/647 |
| 7,458,119 | B2 * | 12/2008 | Hornbach et al. | 5/618 |
| 7,512,998 | B2 * | 4/2009 | Martin et al. | 5/81.1 R |
| 7,640,608 | B2 * | 1/2010 | Smith et al. | 5/617 |
| 7,665,166 | B2 * | 2/2010 | Martin et al. | 5/611 |
| 7,669,260 | B2 * | 3/2010 | Smith et al. | 5/611 |
| 7,774,873 | B2 * | 8/2010 | Martin et al. | 5/81.1 R |
| 7,784,127 | B2 * | 8/2010 | Kuro et al. | 5/601 |
| 7,870,624 | B1 * | 1/2011 | Winston | 5/611 |
| 8,015,638 | B2 * | 9/2011 | Shimada et al. | 5/611 |
| 8,028,359 | B2 * | 10/2011 | Parson et al. | 5/619 |
| 8,060,960 | B2 * | 11/2011 | Jackson | 5/611 |
| 8,074,309 | B2 * | 12/2011 | Hutchison et al. | 5/610 |
| 8,127,380 | B2 * | 3/2012 | Wurdeman | 5/618 |
| 8,196,237 | B2 * | 6/2012 | Herbst et al. | 5/600 |
| 8,291,532 | B2 * | 10/2012 | Hornbach et al. | 5/611 |
| 8,336,140 | B2 * | 12/2012 | Parson et al. | 5/619 |
| 2003/0079288 | A1 * | 5/2003 | Cook et al. | 5/611 |
| 2004/0172757 | A1 * | 9/2004 | Somasundaram | 5/601 |
| 2006/0026762 | A1 * | 2/2006 | Hornbach et al. | 5/611 |
| 2006/0207021 | A1 * | 9/2006 | Brunson et al. | 5/81.1 R |
| 2007/0000056 | A1 * | 1/2007 | Ward et al. | 5/611 |
| 2007/0079443 | A1 * | 4/2007 | Hoth et al. | 5/601 |
| 2008/0189861 | A1 * | 8/2008 | Smith et al. | 5/611 |
| 2009/0049613 | A1 * | 2/2009 | Dippl et al. | 5/611 |
| 2009/0119843 | A1 * | 5/2009 | Rodgers et al. | 5/611 |
| 2009/0126114 | A1 * | 5/2009 | Kral et al. | 5/611 |
| 2010/0064438 | A1 * | 3/2010 | Knudsen et al. | 5/611 |
| 2011/0113556 | A1 * | 5/2011 | Roussy et al. | 5/611 |

* cited by examiner

*Primary Examiner* — William Kelleher
*Assistant Examiner* — David E Sosnowski
(74) *Attorney, Agent, or Firm* — Coats and Bennett, PLLC

(57) ABSTRACT

An examination table is shown that is capable of being lowered to a relatively low height. The examination table includes a base, a lifting mechanism, an upper frame structure, and a patient support disposed on or supported directly or indirectly by the upper frame. The lifting mechanism interconnects the base with the upper frame structure. In order to reduce the height of the examination table when it assumes the lower position, the lifting mechanism is projected upwardly through a lower portion of the upper frame such that an upper portion of the lifting mechanism assumes a position in an open area of the upper frame. Once the upper portion of the lifting mechanism is projected into the upper frame, the lifting mechanism is attached to the upper frame such that the upper frame moves up and down as the lifting mechanism moves up and down.

19 Claims, 4 Drawing Sheets

LOW PROFILE PATIENT EXAMINATION TABLE

CROSS-REFERENCE TO RELATED APPLICATION

This application claims priority under 35 U.S.C. §119(e) from the following U.S. provisional application: Application Ser. No. 61/235,104 filed on Aug. 19, 2009. That application is incorporated in its entirety by reference herein.

FIELD OF THE INVENTION

The present invention relates to patient examination tables.

BACKGROUND OF THE INVENTION

Patient examination tables generally include a base, an upper frame that supports an upholstered top surface, and a lift assembly operatively interconnected between the base and the upper frame for moving the upper frame between a lower position and an upper position. In the lower position, the examination table permits patients to access the top surface of the table or to be moved onto the top surface of the examination table. In the raised or upper position, the patient examination table positions the patient in a location that facilitates the examination of the patient.

It has always been a challenge to design a patient examination table that can be lowered to a relatively low position. There are many advantages to a patient examination table that can reach relatively low elevations. First, a patient examination table that is capable of achieving a very low profile minimizes the amount of lifting required to move immobile patients or overweight and obese patients onto the table. In addition, a patient examination table that will reach a relative low profile can accommodate a new type of patient examination system where a convertible wheelchair is rolled over the examination table and coupled thereto, enabling the patient to remain in the convertible wheelchair during the entire patient examination process. Designing patient examination tables so that they are able to reach these relatively low positions is difficult and challenging. In order to reach very low heights, the design of a patient examination table must take into account the structural components of the table along with the operating mechanisms that form a part of the examination table, especially the lift mechanism or assembly. More particularly, the design must accommodate the lifting mechanism when the examination table assumes the lower position. Again, this is challenging because the lifting mechanisms occupy space and remain anchored or connected to the base and the upper frame. Typically, lift assemblies rest on or are supported by the base and they must attach to an upper movable frame. For the most part, in patient examination table designs, little consideration seems to have been given to how the lift assembly is seated and attached.

Therefore, there is a need for a patient examination table that is capable of reaching relatively low elevations to reduce patient lifting and generally make it easier for patients to access the examination table.

SUMMARY OF THE INVENTION

The present invention relates to an examination table whose top surface assumes a relatively low position compared to existing examination tables when the examination table assumes the lower position.

In one particular embodiment of the present invention, the examination table comprises a base and a lift assembly wherein the lift assembly is seated in a recess formed in the base.

In another embodiment of the present invention there is provided a patient examination table having an upper frame and the lift assembly is seated or extended into an open area in the upper frame.

More particularly, in another embodiment of the present invention the examination table includes a base, an upper frame, and one or more lift assemblies or actuators operatively interconnected between the base and the upper frame. The one or more actuators are operative to move the upper frame up and down between a lower position and an upper position. The bottom portion of the one or more actuators or lift assemblies is seated in a recess in the base thereby effectively lowering the lower portions of the actuators. Furthermore, the one or more actuators include upper portions that are extended into an open area in the upper frame, thereby effectively lowering the upper frame with respect to the actuators.

Other objects and advantages of the present invention will become apparent and obvious from a study of the following description and the accompanying drawings which are merely illustrative of such invention.

DESCRIPTION OF EXEMPLARY EMBODIMENTS

Figure 1:
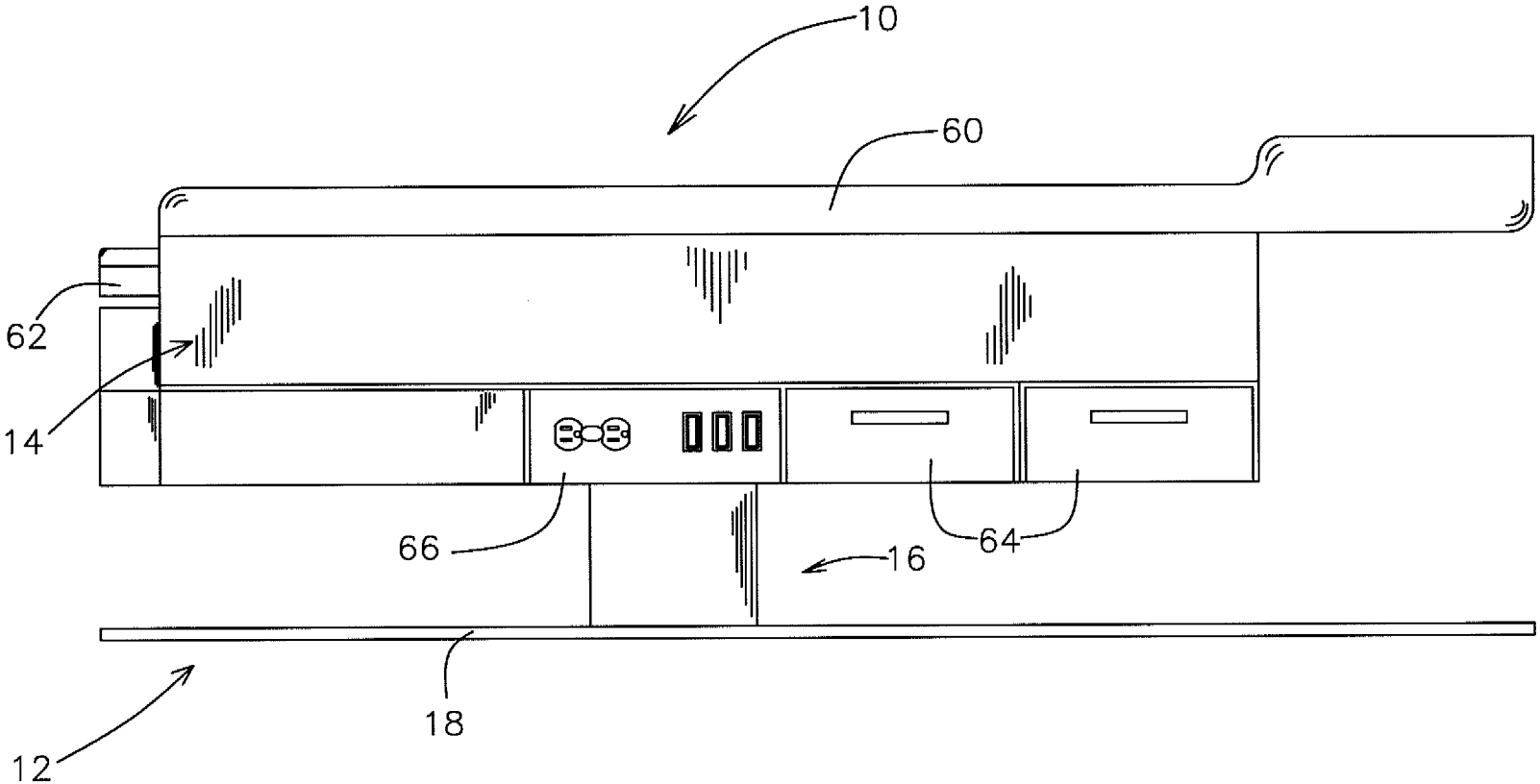
FIG. 1 is a side elevational view that illustrates the base, upper frame and lifting mechanism of a patient examination table.

With further reference to the drawings, there is shown therein a patient examination table which is indicated generally by the number 10. As will be described subsequently herein, the patient examination table 10 is designed such that its top portion reaches a relatively low position when the examination table is fully lowered, especially with respect to commercially available patient examination tables that are available today.

FIGS. 1-4 of the drawings illustrate the three basic components of the patient examination table that enable it to be lowered to a relatively low height. These three basic components include the base of the examination table referred to generally by the number 12, an upper frame indicated generally by the number 14 and a lifting mechanism or assembly indicated generally by the number 16. While the present invention is described herein and shown in the drawings, a more complete and unified understanding of patient examination tables can be gained from the disclosure found in U.S. Pat. No. 7,512,998 which is expressly incorporated herein by reference. As seen in this patent, the patient examination table includes a base structure, a lifting mechanism, and an upper frame.

Returning to the drawings in FIGS. 1-4, the base comprises a plate 18 having a certain or selected height or depth. Located in the plate 18 is one or more recesses 20. Each recess 20 is designed to receive a lifting mechanism 16. In some cases the examination table 10 will include only one lifting mechanism 16 and in other cases the examination table will include more than one lifting mechanism. In the embodiment illustrated herein, the examination table 10 includes a single lifting mechanism 10 that is generally centrally located. Hence, there is one recess 20 for receiving the base or lower portion of the lifting mechanism 16.

Figure 2:
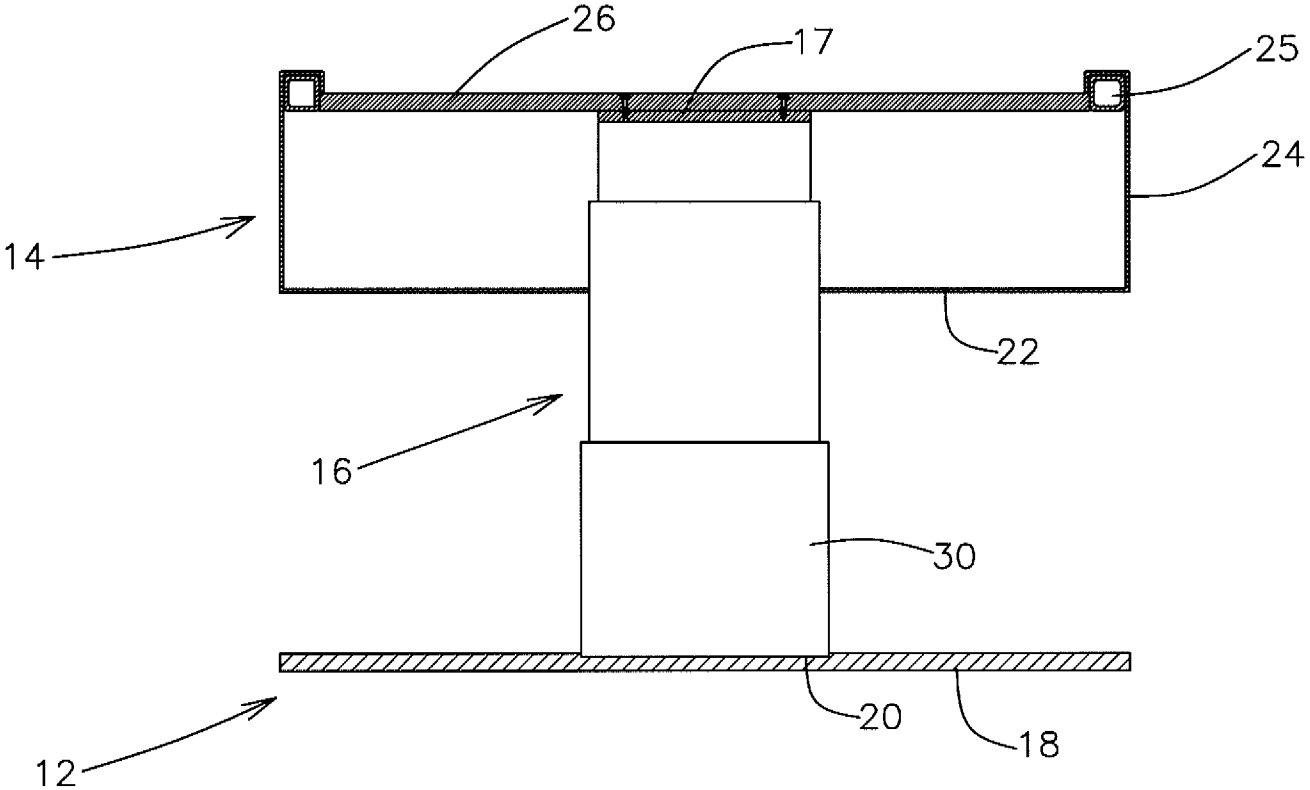
FIG. 2 is a transverse cross-sectional view of the examination table shown in FIG. 1.
Figure 3:
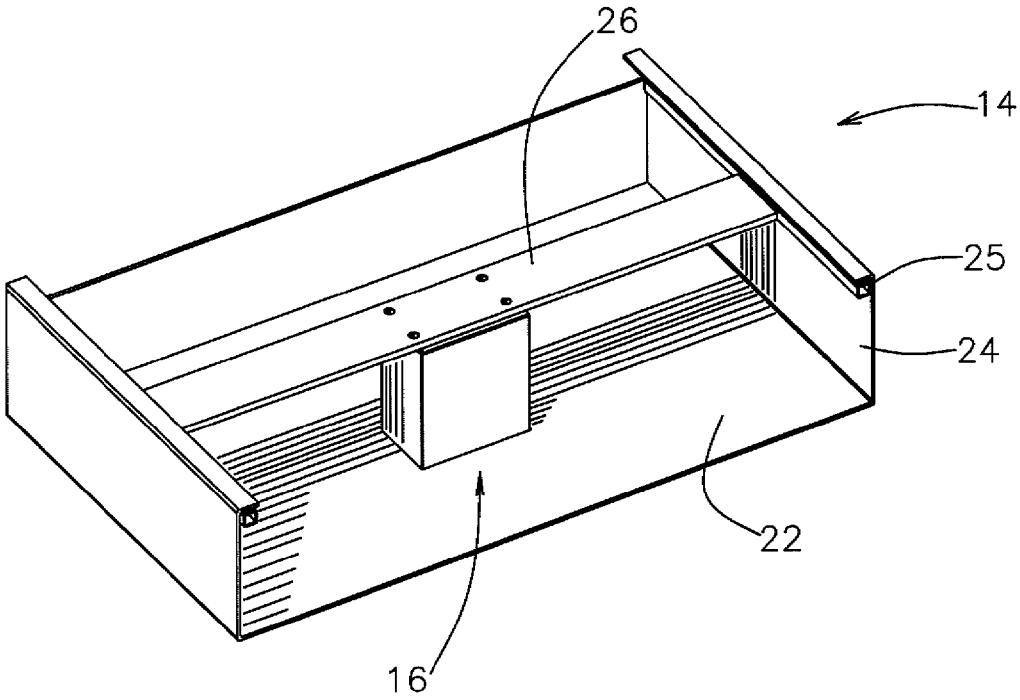
FIG. 3 is a fragmentary prospective view showing a portion of the upper frame and a portion of the lift mechanism or assembly projecting into the upper frame.

Upper frame 14 forms the frame structure that at least indirectly supports a patient. As seen in the drawings, the upper frame 14 underlies and supports an upholstered patient support 60 that can be raised and articulated with respect to the upper frame. Upper frame structures in patient examination tables can vary greatly. In the embodiment illustrated herein, the upper frame 14 is constructed of a heavy gauge sheet metal and includes a bottom 22 and a surrounding side wall 24. In the embodiment shown in FIGS. 1-3, the upper portions of the side walls 24 are bent to at least partially encircle a reinforcing bar 25. See FIG. 2. Reinforcing bar 25 is secured by a tack weldment or other fastening means to the upper portions of the surrounding sides 24. Upper frame 14 includes a connecting bar or plate 26. In the embodiment illustrated in FIG. 2, the connecting bar 26 extends transversely across the top portion of the upper frame 14. As shown in FIG. 2, the connecting bar 26 is welded or secured by other suitable means on opposite ends thereof to the reinforcing bar 25 that extends around the upper perimeter of at least a portion of the upper frame 14.

Bottom 22 of the upper frame includes at least one opening, and as will be appreciated from subsequent portions of this disclosure, this opening permits an upper portion of the lift mechanism 16 to be extended therethrough for engagement and connection with the connecting bar 26.

As seen in the drawings, the lift mechanism 16 is disposed between the base 12 and upper frame 14. More particularly the lift mechanism 16 is securely stationed to the plate 18 of the base and extends upwardly therefrom where an upper portion of the lift mechanism projects through the opening in the bottom 22 of the upper frame, and where an upper portion of the lift mechanism 16 is secured directly to the connecting bar 26. In the case of this embodiment, as shown in FIG. 2, the lift mechanism 16 includes a top connecting plate 17 that is secured directly to the connecting bar 26 by bolts or other attaching means.

The lift mechanism 16 for the examination table 10 can assume various types and forms. For example, the lift mechanism 16 may include one or more linear actuators. Shown in the drawings is a lift mechanism that can be termed a column lift. It is a telescoping lift device that can be powered in various ways, such as by electricity or by fluid. Such column lifts are known and are commercially available. For purposes of discussion, the column lift shown in the drawings is indicated by the numeral 30 and is of a telescoping design. As seen in FIG. 2, the column lift 30 includes three sections, two of which move in a telescopic fashion from a retracted position generally within the lower portion of the column lift and an upper extended position as shown in FIG. 2.

The column lift 30 is positioned such that the lower portion thereof is seated within the recess 20 formed in the plate 18 of the base 12. See FIG. 2. The bottom of the column lift 30 can be secured in the recess 20 by bolts or other suitable fastening means.

The upper end of the column lift 30 includes the top plate 17 that is connected to the underside of the connecting bar 26. Again, note that the upper portion of the column lift 30 projects through an opening formed in the bottom 22 of the upper frame 14.

As illustrated in the drawings, both the bottom and top portions of the column lift 30 are to some degree recessed in the base 12 and upper frame 14. This effectively lowers the upper frame and the patient support 60 when the examination table assumes the lower position. That is, by recessing or extending the column lift 30 downwardly into the base 12 and at the same time projecting the column lift into the upper frame 14, the distance between the upper frame and the base is reduced when the patient examination table 10 assumes the lower position.

The design described above has the effect of reducing the height of the examination table one-fourth to one-half inch when in the lower position compared to conventional patient examination table.

Various utility structure or accessories can be integrated into or supported by the upper frame 14. The examination table shown in FIG. 1 includes a few exemplary utilitarian features that are supported directly or indirectly by the upper frame 14. For example, as shown in FIG. 1, there is provided two drawers 64 that can serve as storage compartments for various supplies that a doctor or nurse might need during the course of an examination. Further, there is a utility panel 66 that depends downwardly from both sides of the examination table. In addition, the examination table includes an extendable upholstered panel 62 that can be extended from the examination table or retracted into the examination table as shown in FIG. 1.

Figure 4:
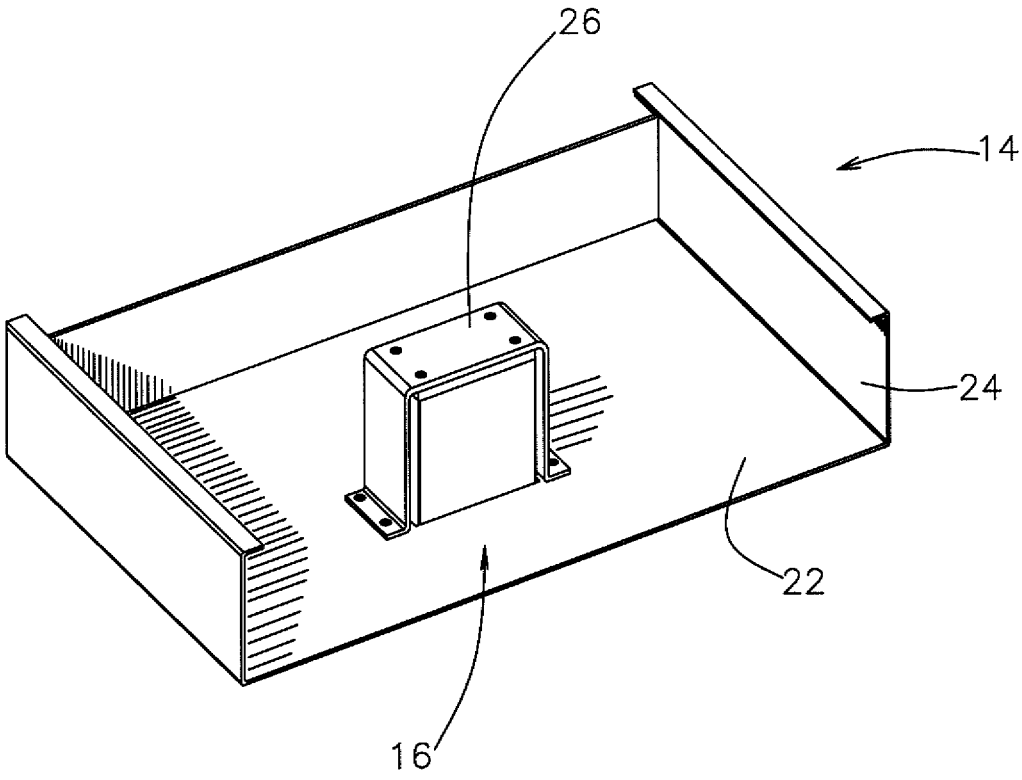
FIG. 4 is a perspective view of an alternate design for securing the upper frame to the lift mechanism.

FIG. 4 shows an alternate embodiment for connecting the lift assembly 16 to the upper frame 14. In this case, the connecting bar 26 which is sometimes referred to as a connecting plate or a push bar, assumes a generally inverted U-shaped configuration and attaches the lift assembly 16 to the bottom panel 22 of the upper frame 14. Note that the connecting bar 26 in the FIG. 4 embodiment includes a pair of flanges that rest on the bottom panel 22 and which are connected by bolts or other means to the bottom panel 22. From the flanges, the U-shaped bar 26 extends upwardly and over the top portion of the lift assembly 16. The upper portion of the push bar 26 is connected by bolts or other appropriate fastening means directly to the top plate 17 of the lift mechanism 16.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A patient examination table movable between a lower position and an upper position and particularly configured to assume a relatively low profile when in the lower position, the patient examination table comprising:

a. a base;

b. an upper frame forming a part of the patient examination table, the upper frame including a lower portion, sides and an open interior area;

c. a patient support supported on the upper frame;

d. the open interior area being bound by the patient support and the sides of the upper frame;

e. a lift assembly operatively connected between the base and the upper frame and movable back and forth from a retracted position to an extended position to raise and lower the examination table;

f. the lift assembly including an upper portion that projects upwardly through the lower portion of the upper frame and therefrom projects further upwardly through the interior area bounded by the patient support and the sides of the upper frame and wherein the upper portion of the lift assembly connects to an upper portion of the upper frame adjacent the patient support;

g. wherein the upper portion of the lift assembly is secured to the upper frame such that as the lift assembly is activated and moves up and down the upper frame is constrained to move up and down with the lift assembly; and h. wherein the upper frame includes a sheet metal frame structure having a bottom panel and opposed sides; an opening formed in the bottom panel; and wherein the upper portion of the lift assembly projects through the opening in the bottom panel; and wherein a substantial portion of the lift assembly lies above the bottom panel of the upper frame.

2. The patient examination table of claim 1 wherein the lift assembly includes a lower portion that is seated within a recess formed in the base.

3. The patient examination table of claim 1 wherein the upper frame includes a connecting bar that is secured to an upper end portion of the lift assembly.

4. The patient examination table of claim 3 wherein the connecting bar extends transversely across the upper frame and is supported directly or indirectly by the sides.

5. The patient examination table of claim 3 wherein the connecting bar assumes a generally inverted U-shape and is connected to an upper end of the lift assembly and to the bottom panel of the sheet metal frame.

6. The patient examination table of claim 1 wherein the upper frame includes a connecting bar secured to the upper frame and also secured to the lift assembly at one or more points above the bottom panel.

7. The patient examination table of claim 1 wherein the lift assembly includes a column lift having multiple telescoping sections including an upper section that is attached to the upper frame.

8. The patient examination table of claim 1 wherein the lift assembly includes a column lift having multiple telescoping sections and wherein at least one of the telescoping sections projects upwardly through the opening formed in the bottom panel of the sheet metal frame, and wherein an upper telescoping section is connected to the upper frame at one or more points above the bottom panel.

9. The patient examination table of claim 1 wherein the upper frame includes a connector disposed in an upper portion of the upper frame and wherein the lift assembly is connected to the connector in the upper portion of the upper frame.

10. The patient examination table of claim 9 wherein the connector extends transversely across the upper portion of the upper frame.

11. The patient examination table of claim 1 wherein the upper frame includes a connector connected to upper portions of the sides of the upper frame and which extends across the upper frame; and wherein the upper portion of the lift assembly is connected to the connector.

12. The patient examination table of claim 11 wherein the upper frame includes a bottom and wherein the lift assembly projects through and upwardly past the bottom of the upper frame, and wherein the lift assembly connects to the connector in the upper portion of the upper frame.

13. The patient examination table of claim 11 wherein the base includes a recess formed therein and wherein the lift assembly includes a lower portion that is seated within the base.

14. The patient examination table movable between a lower position and an upper position and particularly configured to assume a relatively low profile when in the lower position, the patient examination table comprising:

a. a base;

b. an upper frame forming a part of the patient examination table;

c. the upper frame including an elongated sheet metal frame having a bottom panel, sides extending upwardly from the bottom panel; and an open area formed in the sheet metal frame above the bottom panel and generally between the sides;

d. the bottom panel having at least one opening formed therein;

e. a patient support supported directly or indirectly by the upper frame and configured to receive and support a patient;

f. a lift assembly operatively connected between the base and the upper frame and movable back and forth from a retracted position to an extended position to raise and lower the patient examination table;

g. the lift assembly including an upper portion that projects through the at least one opening in the bottom panel of the sheet metal frame such that a substantial portion of the lift assembly is located in the open area formed in the upper frame above the bottom panel and generally between the sides; and h. a connecting plate secured to the sheet metal frame and also secured to an upper end portion of the lift assembly, and wherein the connecting plate is disposed above the bottom panel of the sheet metal frame.

15. The patient examination table of claim 14 wherein the connecting plate extends transversely across the sheet metal frame and is spaced above the bottom panel, and wherein the lift assembly includes an upper plate that is attached to the connecting plate.

16. The patient examination table of claim 14 wherein the connecting plate comprises a generally inverted U-shaped structure that extends over the upper portion of the assembly and is attached to both the lift assembly and the bottom panel of the sheet metal frame.

17. The patient examination table of claim 14 wherein the base includes a recess and wherein a lower portion of the lift assembly is seated within the recess within the base.

18. The patient examination table of claim 14 wherein the lift assembly comprises a column lift having at least two telescoping sections and wherein at least one of the telescoping sections of the column lift projects up through the opening in the bottom panel of the sheet metal frame.

19. The patient examination table of claim 18 wherein the column lift includes at least three telescoping sections that comprise a bottom section, an intermediate section, and an upper section; and wherein the upper section of the lift column projects through the opening in the bottom panel and is secured to the upper frame.

* * * * *